US008267160B2

(12) United States Patent
Hancock

(10) Patent No.: US 8,267,160 B2
(45) Date of Patent: Sep. 18, 2012

(54) LOUVERED PLATE FIN

(75) Inventor: Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 460 days.

(21) Appl. No.: 12/539,398

(22) Filed: Aug. 11, 2009

(65) Prior Publication Data

US 2011/0036551 A1 Feb. 17, 2011

(51) Int. Cl.
*F28F 1/22* (2006.01)

(52) U.S. Cl. ..... 165/151; 165/182

(58) Field of Classification Search ..... 165/151, 165/152

See application file for complete search history.

(56) References Cited

U.S. PATENT DOCUMENTS

| | | | | | |
|---|---|---|---|---|---|
| 3,003,749 | A | | 10/1961 | Morse | |
| 3,265,127 | A | * | 8/1966 | Nickol et al. | 165/152 |
| 4,300,629 | A | | 11/1981 | Hatada et al. | |
| 4,469,167 | A | | 9/1984 | Itoh et al. | |
| 4,691,768 | A | | 9/1987 | Obosu | |
| 4,705,105 | A | | 11/1987 | Cur | |
| 4,723,599 | A | * | 2/1988 | Hanson | 165/151 |
| 4,860,822 | A | | 8/1989 | Sacks | |
| 5,042,576 | A | * | 8/1991 | Broadbent | 165/151 |
| 5,056,594 | A | | 10/1991 | Kraay | |
| 5,099,914 | A | | 3/1992 | Reifel | |
| 5,168,923 | A | * | 12/1992 | Sacks | 165/151 |
| 5,553,663 | A | | 9/1996 | Yu | |
| 5,692,561 | A | | 12/1997 | Kang et al. | |
| 5,722,485 | A | | 3/1998 | Love et al. | |
| 5,730,214 | A | | 3/1998 | Beamer et al. | |
| 6,786,274 | B2 | * | 9/2004 | Bemisderfer | 165/151 |
| 7,124,813 | B2 | | 10/2006 | Kester | |
| 7,428,920 | B2 | * | 9/2008 | Antonijevic | 165/152 |
| 2004/0206484 | A1 | * | 10/2004 | Shimoya et al. | 165/152 |

FOREIGN PATENT DOCUMENTS

| | | | |
|---|---|---|---|
| JP | 04369394 | A | * 12/1992 |
| JP | 8049870 | A | 2/1996 |
| JP | 10141805 | A | * 5/1998 |
| JP | 2006308238 | A | 11/2006 |

OTHER PUBLICATIONS

PCT International Search Report; PCT Application No. PCT/US2010/045207; Mar. 31, 2011; 5 pgs.

PCT International Written Opinion; PCT Application No. PCT/US2010/045207; Mar. 31, 2011; 3 pgs.

* cited by examiner

*Primary Examiner* — Allen Flanigan

(74) *Attorney, Agent, or Firm* — Conley Rose, P.C.; J. Robert Brown, Jr.

(57) ABSTRACT

A fin has a substantially flat base plane with a first side facing a first direction and a second side facing a second direction. The fin also has a first louver with a leading edge closer to the base plane and a trailing edge offset from the base plane in the first direction, a second louver located at least partially downstream of the first louver, with a leading edge offset from the base plane in the second direction and a trailing edge offset from the base plane in the first direction, and a third louver located at least partially downstream of the second louver, the third louver having a leading edge offset from the base plane in the second direction and a trailing edge closer to the base plane than the third louver leading edge.

20 Claims, 7 Drawing Sheets

LOUVERED PLATE FIN

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Conventional air conditioning systems generally comprise a compressor, a condenser coil, a condenser fan for passing air through the condenser coil, a flow restriction device, an evaporator coil, and an evaporator blower for passing air through the evaporator coil. The condenser coil and the evaporator coil are each designed as heat exchangers with internal tubing for carrying refrigerant. Further, evaporator coils and condenser coils sometimes comprise a plurality of fins disposed along a length of the internal tubing so that the internal tubing passes through holes formed in the adjacent plate fins.

The compressor operates to compress refrigerant into a hot and high pressure gas, which is passed through the internal tubing of the condenser coil. As the refrigerant is passed through the condenser coil, the condenser fan operates to pass ambient air across the condenser coil, thereby removing heat from the refrigerant and condensing the refrigerant into liquid form. The liquid refrigerant passes through a flow restriction device, which causes the refrigerant to transform into a colder and lower pressure liquid/gas mixture that proceeds to the evaporator. As the mixture is passed through the evaporator coil, the evaporator blower forces ambient air across the evaporator coil, thereby providing a cooling and dehumidifying effect to the ambient air, which is then distributed to the space to be temperature controlled.

In some applications, heat exchangers (i.e., evaporator or condenser coils) comprise a plurality of fins that are arranged so that adjacent fins are substantially parallel to each other and offset by a fin pitch distance, and a plurality of refrigerant tubes disposed generally orthogonally to the plurality of fins. Most generally, a fin may be described as a thin plate constructed of metal or other materials suitable for conducting heat and comprising a series of holes formed therein that are suitable for receiving refrigerant tubing therethrough. A plurality of fins comprising substantially similar hole patterns may be arranged in a stack, in some embodiments with adjacent fins equally offset by the fin pitch distance, so that refrigerant tubes may each be received through corresponding holes in the plurality of fins. In other words, each refrigerant tube may be inserted substantially orthogonally through corresponding holes in the stack of fins so that the fins are disposed along the refrigerant tubing, thereby forming what may be referred to as a slab of the heat exchanger.

SUMMARY OF THE DISCLOSURE

In some embodiments, this disclosure relates to a fin comprising a substantially flat base plane having a first side facing a first direction and a second side facing a second direction. The fin further comprises a first louver comprising a leading edge and a trailing edge, wherein the leading edge is closer to the base plane than the trailing edge and the trailing edge is offset from the base plane in the first direction; a second louver located at least partially downstream of the first louver, the second louver comprising a leading edge and a trailing edge, wherein the leading edge is offset from the base plane in the second direction and the trailing edge is offset from the base plane in the first direction; and a third louver located at least partially downstream of the second louver, the third louver comprising a leading edge and a trailing edge, wherein the leading edge is offset from the base plane in the second direction and the trailing edge is closer to the base plane than the leading edge.

In some embodiments, the present disclosure relates to a fin comprising a substantially flat base plane having a first side facing a first direction and a second side facing a second direction. The fin further comprises a central louver comprising a leading edge and a trailing edge, wherein the leading edge and the trailing edge are offset from the base plane in the same one of the first direction and the second direction; and a nearest located louver located nearest the central louver, the nearest located louver comprising a nearest located edge located nearest the central louver, wherein the nearest located edge is nearer the base plane than any portion of the central louver.

In some embodiments the present disclosure relates to a fin comprising a substantially flat base plane having a first side facing a first direction and a second side facing a second direction. The fin further comprises a first louver comprising a leading edge and a trailing edge, wherein the leading edge is closer to the base plane than the trailing edge, the trailing edge is offset from the base plane in the first direction, and the first louver is formed into a concave curve open toward the first direction; a second louver located at least partially downstream of the first louver, the second louver comprising a leading edge and a trailing edge, wherein the leading edge is offset from the base plane in the second direction, the trailing edge is offset from the base plane in the first direction, and is substantially flat; a third louver located at least partially downstream of the second louver, the third louver comprising a leading edge and a trailing edge, wherein the leading edge is offset from the base plane in the second direction, the trailing edge is closer to the base plane than the leading edge, and the third louver is formed into a concave curve open toward the second direction; a fourth louver located at least partially downstream of the third louver, the fourth louver comprising a leading edge and a trailing edge, wherein both the leading edge and the trailing edge are offset in the first direction, and wherein the fourth louver is substantially flat; a fifth louver located at least partially downstream of the fourth louver, the fifth louver comprising a leading edge and a trailing edge, wherein the trailing edge is offset from the base plane in the second direction, the leading edge is closer to the base plane than the trailing edge, and wherein the fourth louver is formed into a concave curve open toward the second direction; a sixth louver located at least partially downstream of the fifth louver, the sixth louver comprising a leading edge and a trailing edge, wherein the leading edge is offset from the base plane in the first direction, the trailing edge is offset from the base plane in the second direction, and wherein the sixth louver is substantially flat; and a seventh louver located at least partially downstream of the sixth louver, the seventh louver comprising a leading edge and a trailing edge, wherein the trailing edge is closer to the base plane than the leading edge, the leading edge is offset from the base plane in the first direction, and wherein the seventh louver is formed into a concave curve open toward the first direction.

BRIEF DESCRIPTION OF THE DRAWINGS

For a more detailed description of the various embodiments disclosed herein, reference will now be made to the accompanying drawings, wherein.

DETAILED DESCRIPTION

Figure 1:
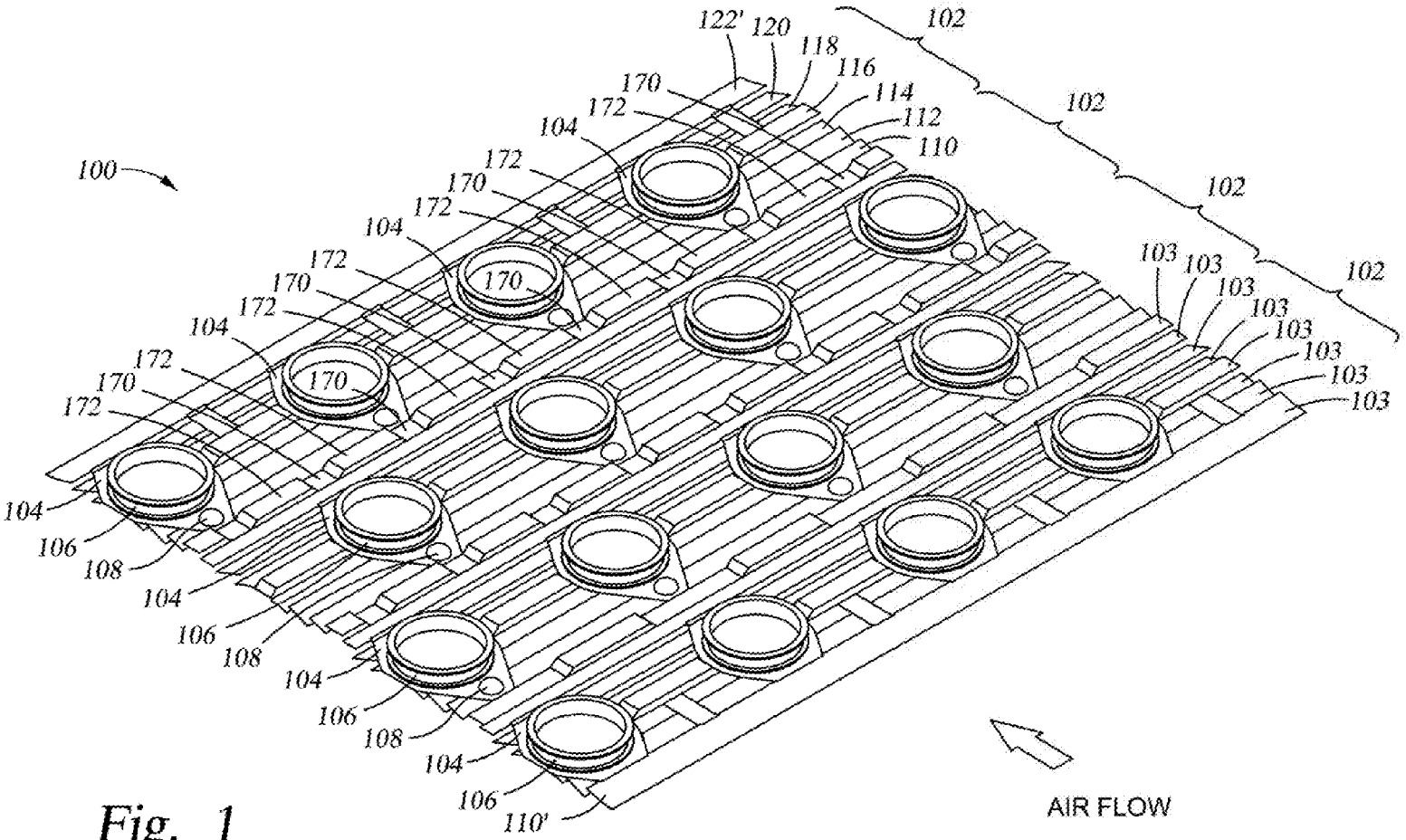
FIG. 1 is an oblique view of the top side of an embodiment of a fin as seen from an upstream location.
Figure 2:
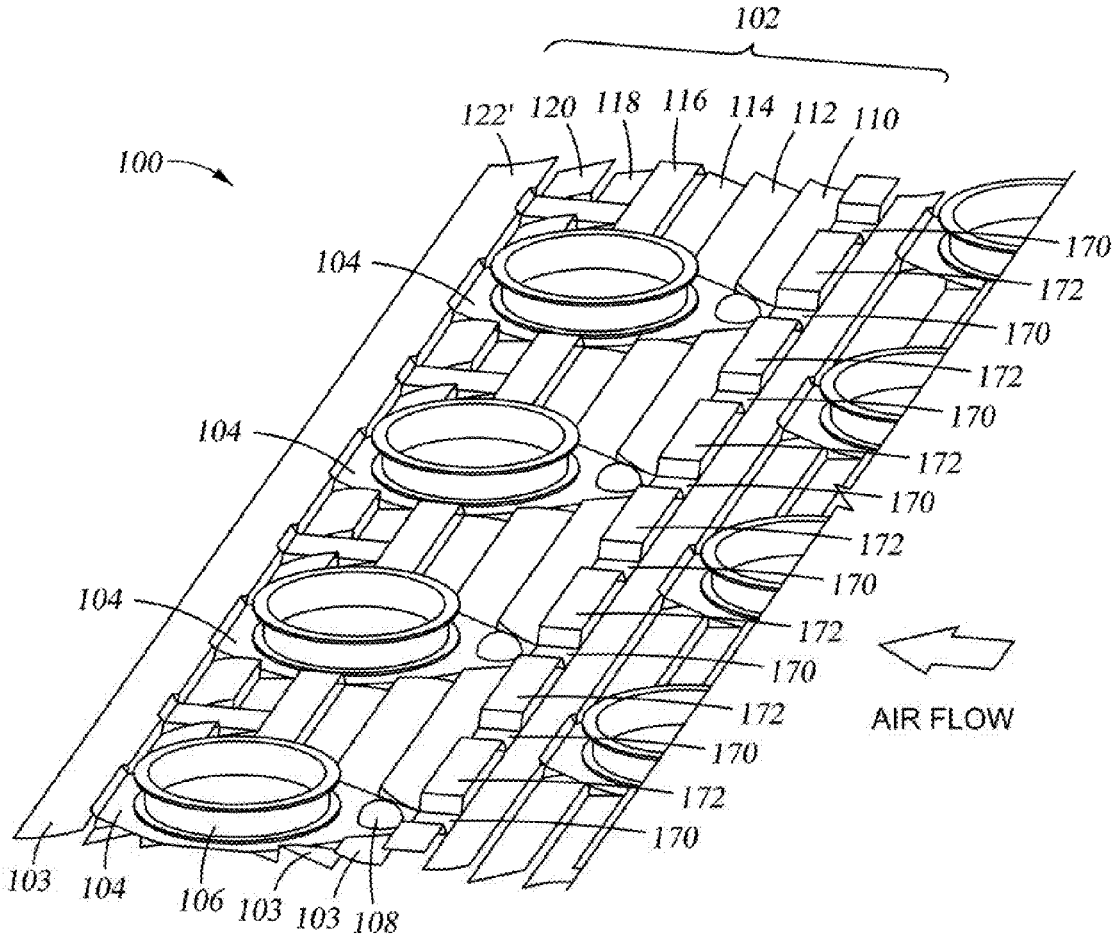
FIG. 2 is another oblique view of the top side of the fin of FIG. 1 as seen from an upstream location.
Figure 3:
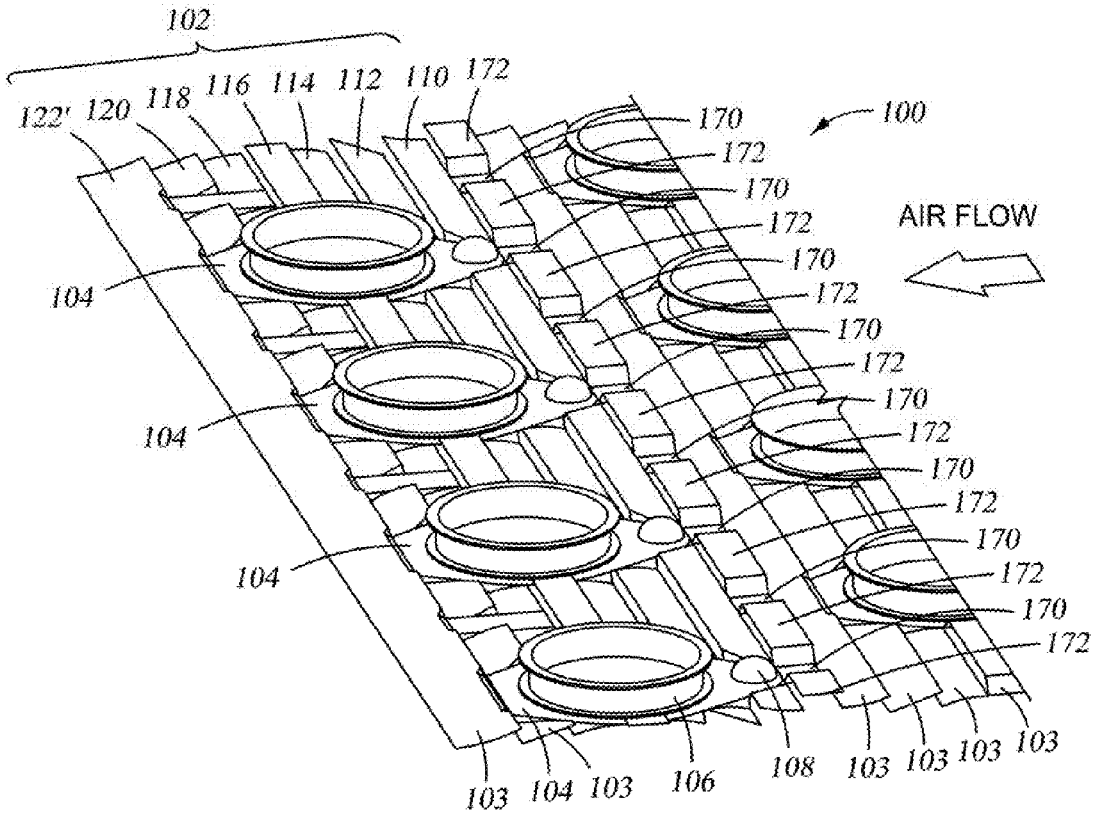
FIG. 3 is an oblique view of the top side of the fin of FIG. 1 as seen from a downstream location.
Figure 4:
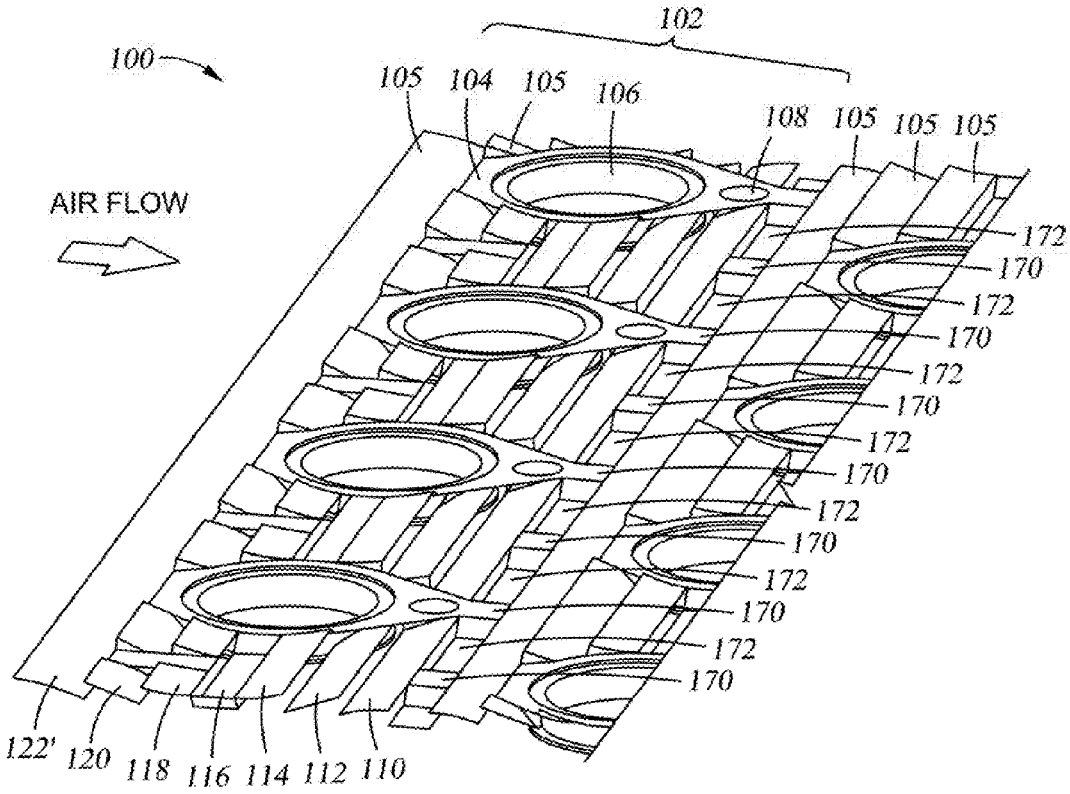
FIG. 4 is an oblique view of the bottom side of the fin of FIG. 1 as seen from an upstream location.
Figure 5:
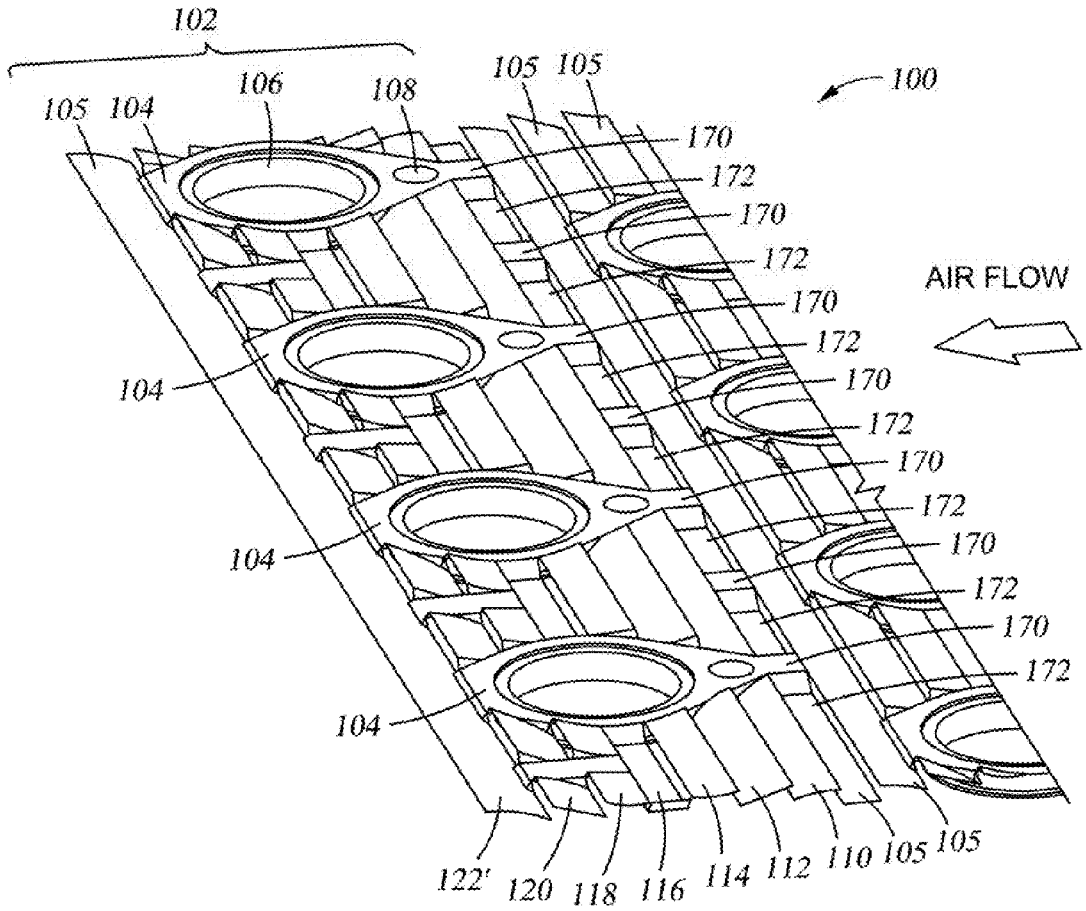
FIG. 5 is an oblique view of the bottom side of the fin of FIG. 1 as seen from a downstream location.

Some fins of heat exchangers comprise forms and features that increase heat transfer between the fins and the airflow passing over the fins. For example, fins may be constructed of relatively inexpensive and flexible flat finstock which may be easily lanced (cut and offset) or louvered (cut and twist) through well known manufacturing processes using dies and presses to improve heat transfer performance. However, some fins may be constructed by forming a wavy finstock from relatively thicker and more expensive flat finstock. Wavy finstock demonstrates good heat transfer performance with less pressure drop than lanced and/or louvered flat finstock. To further improve heat transfer performance, lanced and/or louvered features may also be formed on the wavy finstock. While some features formed on a wavy finstock in combination with the wavy or curved nature of the wavy finstock may offer improved heat transfer, the dies needed to form the fins from wavy finstock are more complex and more expensive. Because the flat finstock used to form the wavy finstock is thicker and more expensive than the thinner finstock that may be used when the finstock need not be pressed into a wavy form, use of wavy finstock is sometimes avoided due to cost considerations.

The present disclosure is directed to flat fins and methods of making the flat fins with features that provide the heat transfer and low pressure drop performance of some lanced and/or louvered wavy fins. Accordingly, the present disclosure provides fins formed from flat finstock and methods of making fins formed from flat finstock that comprise louvers that direct airflow in a manner substantially the same as some louvered wavy fins. In this disclosure, the terms "upstream" and "downstream" are intended to indicate relative positions as related to the general intended overall direction of airflow across a fin of the present disclosure. Accordingly, for example, where a feature of a fin of this disclosure is described as being upstream relative to another feature of the fin, the upstream feature of the fin can be understood as being generally disposed so that the upstream feature encounters a portion of airflow prior to the relative downstream feature encountering the same portion of airflow. Further, it will be understood that the term "leading" may also refer to a relatively upstream located feature. Similarly, it will be understood that the term "trailing" may also refer to a relatively downstream located feature. Such relative positional terminology is well known in the art of heat exchanger fins.

Referring now to FIGS. 1-5, various oblique views of the top side 103 and bottom side 105 of a fin 100 are shown from upstream and downstream positions. Fin 100 generally comprises a plurality of substantially similar finstrips 102. Each finstrip 102 comprises a plurality of non-louvered, generally flat, substantially oval-shaped base regions 104. Each base region 104 carries a substantially annular collar 106 surrounding a hole formed in the finstrip 102. The collars 106 serve to increase the mechanical strength of the joinder between the fin 100 and refrigerant tubes that may extend through the hole and be carried within the collar 106. The collar 106 also serves to increase the heat conductivity between the tubes and the fin 100. The fin 100, tube, and collar 106 may each be constructed of a suitable thermally-conductive material, such as, but not limited to, copper, aluminum, and the like. In this embodiment, the fin 100 comprises aluminum. Some of the base regions 104 further comprise a bluff body 108 located upstream of the collar 106. The bluff bodies 108 increase turbulence near the collars 106 and tubes and thereby increase heat transfer.

It will be appreciated that the base regions 104 are substantially formed from unbent flat finstock while the plurality of louvers, described in detail below, are formed by cutting, displacing, and twisting the same flat finstock. The bluff bodies 108 are generally formed by pressing the flat finstock. In this embodiment, each finstrip 102 further comprises an upstream louver 110, an upstream straight louver 112, an upstream curved louver 114, a central louver 116, a downstream curved louver 118, a downstream straight louver 120, and a downstream louver 122. Further, each finstrip 102 of a fin 100 may be described as having a base plane 124 from which the louvers 110, 112, 114, 116, 118, 120, 122 are originally part of and subsequently bent or otherwise deformed away from during their creation. In some embodiments, the base regions 104 remain substantially coplanar with the base plane 124.

Figure 6:
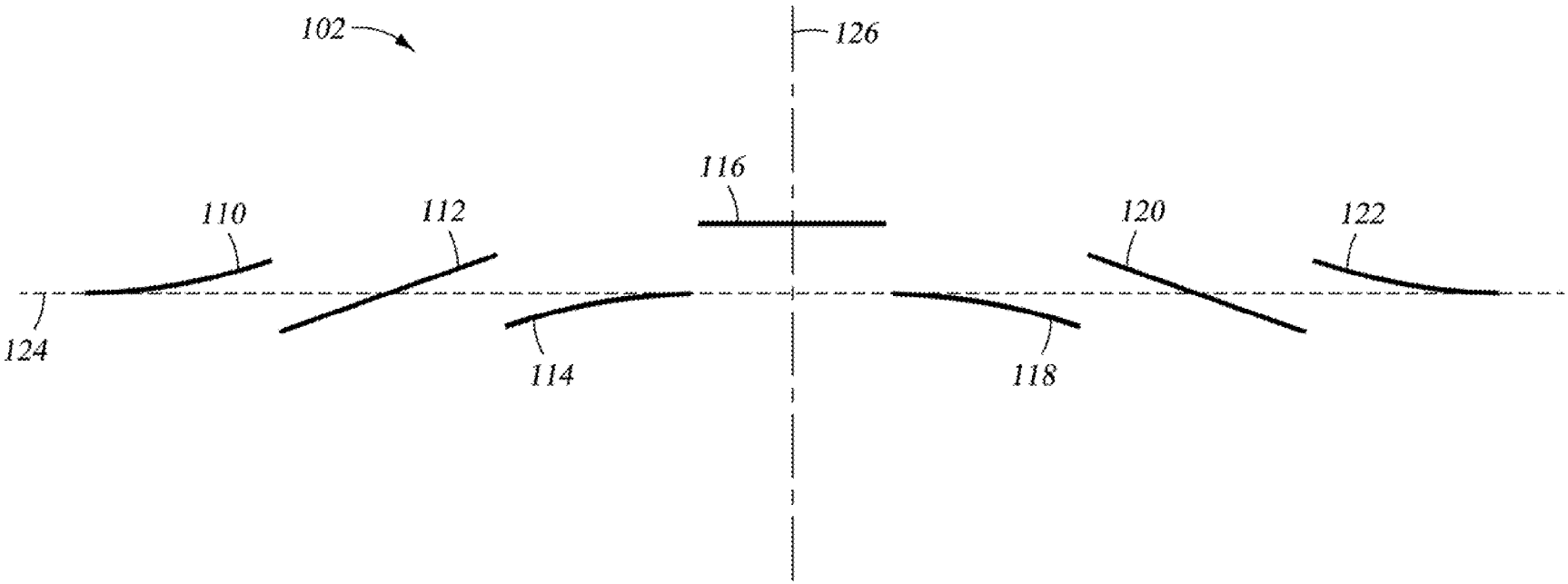
FIG. 6 is a simplified cross-sectional schematic view of a finstrip of the fin of FIG. 1.

Referring now also to FIG. 6, it is clear that the various louvers 110, 112, 114, 116, 118, 120, 122 comprise different cross-sectional shapes and are formed differently with respect to the base plane 124. Upstream louver 110 comprises a cross-sectional area that extends downstream from its leading edge that is substantially coplanar with the base plane 124 and gradually curves in a generally upwardly concave manner away from the base plane 124. The upstream straight louver 112 is located just downstream from the upstream louver 110 and extends downstream from its leading edge that is below the base plane 124, through the base plane 124, and in a manner so that its trailing edge is located above the base plane 124. The upstream straight louver 112 is substantially planar, straight, flat, and/or linear between its leading edge and its trailing edge. In this embodiment, both of the leading edge and the trailing edge of the upstream straight louver 112 are located substantially equidistant from the base plane 124. The upstream curved louver 114 is located just downstream from the upstream straight louver 112 and extends downstream from its leading edge that is below the base plane 124 and gradually curves upward toward the base plane 124 in a generally concave manner so that the concavity is open away from and below the base plane 124. The trailing edge of the upstream curved louver 114 is substantially coplanar with the base plane 124. The central louver 116 is located just downstream of the upstream curved louver 114 and is substantially straight, flat, and/or linear, is substantially parallel to the base plane 124, and is located above the base plane 124 by an offset distance.

A bisection plane 126 is substantially orthogonal to the base plane 124 and substantially bisects the finstrip 102 along its length. In this embodiment, it will be appreciated that the pairs of cross-sectional areas of louvers, 110 and 122, 112 and 120, and 114 and 118, are substantially mirror images of each other about the bisection plane 126. The downstream curved louver 118 is located just downstream of the central louver 116 and extends from its leading edge that is substantially coplanar with the base plane 124 and curves downwardly away from the base plane 124 in a generally concave manner so that the concavity is open away from and below the base plane 124. The downstream straight louver 120 is located just downstream from the downstream curved louver 118 and extends downstream from its leading edge that is above the base plane 124, through the base plane 124, and in a manner so that its trailing edge is located below the base plane 124. The downstream straight louver 120 is substantially planar, straight, flat, and/or linear between its leading edge and its trailing edge. In this embodiment, both of the leading edge and the trailing edge of the downstream straight louver 120 are located substantially equidistant from the base plane 124. Downstream louver 122 comprises a cross-sectional area that extends downstream from its leading edge that is above the base plane 124 and gradually curves in a generally concave manner toward the base plane 124 so that the trailing edge of the downstream louver 122 is substantially coplanar with the base plane 124.

As shown in the drawings, in some embodiments such as those shown at least in FIGS. 1-6, a space between a first louver (such as louver 110 of FIG. 6) and a second louver (such as louver 112 of FIG. 6) is free of louvers. Also as shown in the drawings, in some embodiments such as those shown at least in FIGS. 1-6, a space between the second louver (such as louver 112 of FIG. 6) and a third louver (such as louver 114 of FIG. 6) is free of louvers. Also as shown in the drawings, in some embodiments such as those shown at least in FIGS. 1-6, a space between the third louver (such as louver 114 of FIG. 6) and a fourth louver (such as louver 116 of FIG. 6) is free of louvers. Also as shown in the drawings, in some embodiments such as those shown at least in FIG. 1-6, a louver (such as at least one of louvers 114 and 118 of FIG. 6) located nearest to a central louver (such as louver 116 of FIG. 6) comprises a concave cross-sectional shape that is open generally vertically away from the central louver.

Referring again to FIGS. 1-5, it will be appreciated that the various finstrips 102 of the fin 100 are joined to adjacent finstrips of the same fin 100 by tabs 170 and bridges 172. The tabs 170 are generally flat portions of material that are substantially coplanar with base plane 124 and which, in a manner similar to base regions 104, may be unbent portions of the flat finstock from which the fin 100 is produced. However, the bridges 172, which are formed between some of the tabs 170 along the length of the fin 100, are portions of the fin 100 that are substantially flat, parallel, and offset above the base plane 124 in substantially the same manner central louvers 116 are offset from the base plane 124. Still further, it will be appreciated that the upstream louver 110' of the most upstream located finstrip 102 of fin 100 may comprise a slightly different cross-sectional area than the other upstream louvers 110. Specifically, the upstream louver 110' may comprise a leading edge located below the base plane 124. In this embodiment, the upstream louver 110' extends below the base plane 124 approximately the same distance the leading edge of the upstream straight louvers 112 extend below the base plane 124. Similarly, it will be appreciated that the downstream louver 122' of the most downstream located finstrip 102 of fin 100 may comprise a slightly different cross-sectional area than the other downstream louvers 122. Specifically, the downstream louver 122' may comprise a trailing edge located below the base plane 124. In this embodiment, the downstream louver 122' extends below the base plane 124 approximately the same distance the trailing edge of the downstream straight louvers 120 extend below the base plane 124.

Figure 7:
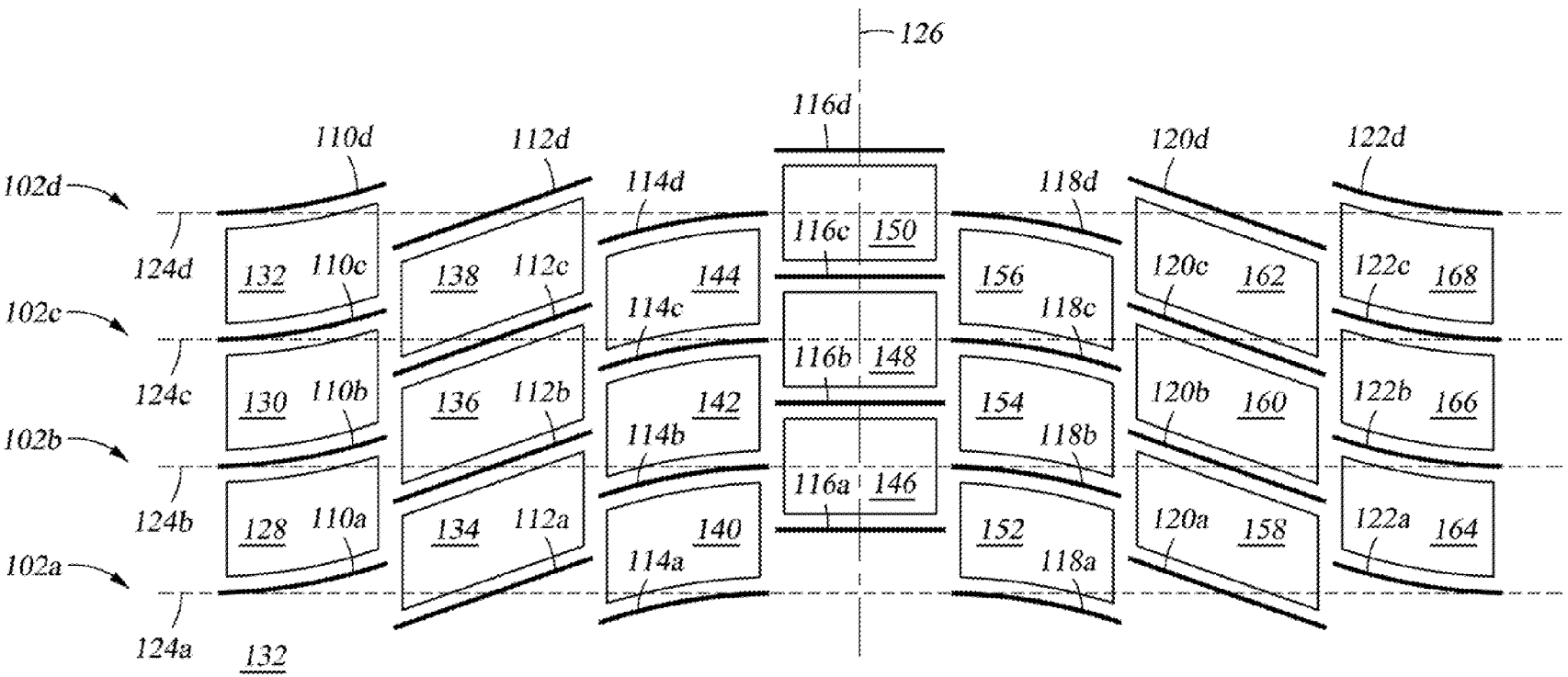
FIG. 7 is a simplified cross-sectional schematic view of a plurality of fins with parallel finstrips.

Referring now to FIG. 7, a simplified schematic cross-sectional diagram of a plurality of fins 100 with parallel finstrips 102, designated 102*a*, 102*b*, 102*c*, and 102*d*, respectively, are shown as arranged in a heat exchanger slab. More specifically, the multiple finstrips 102 are disposed so that the various base planes 124*a*, 124*b*, 124*c*, and 124*d* of the individual finstrips are substantially parallel to each other and so that adjacent finstrips 102 are equally offset from each other according to the fin pitch of the heat exchanger. In some embodiments, a heat exchanger may comprise a fin pitch of about 10-18 fins per inch. Of course, in alternative embodiments, the fin pitch may be different. FIG. 7 is particularly useful in illustrating the manner in which airflow may be passed through a heat exchanger comprising a plurality of fins 100. While specific reference to each may not further be utilized, each airflow space 128, 130, 132, 134, 136, 138, 140, 142, 144, 146, 148, 150, 152, 154, 156, 158, 160, 162, 164, 166, and 168 will be understood as pictorial representations of airflow between adjacent fins 100 and as bound by adjacent and offset pairs of substantially similar louvers. For example, airflow space 128 represents the airflow space between adjacent and offset substantially similar upstream louvers 110*a* and 110*b*.

Still referring to FIG. 7, airflow that enters airflow space 130 between upstream louvers 110*b* and 110*c* may transfer heat with louvers 110*b* and 110*c*. However, as is well known, heat transfer boundary layers begin to form which decrease the efficiency with which heat may transfer between the airflow and the upstream louvers 110*b* and 110*c*. Accordingly, as the airflow exits the airflow space 130, the airflow may be substantially divided, and in this embodiment substantially bisected by the upstream straight louver 112*c*, thereby diverting the airflow in to the airflow spaces 136 and 138. As the airflow enters the airflow spaces 136 and 138, the airflow is mixed with airflows that originated from airflow spaces 128 and 132, respectively. As the airflow in airflow space 136 moves downstream, boundary layers again begin to form which hinder efficient heat transfer. Accordingly, as the airflow exits the airflow space 136, the airflow is substantially bisected by the upstream curved louver 114*c*. Inspection of FIG. 7 reveals that such dividing and mixing of airflows is repeated as the airflows exit the various airflow spaces. Of course, in heat exchanger slabs comprising a plurality of fins such as fin 100 that comprises a plurality of finstrips 102, the airflow that exits airflow spaces 164, 166, 168 may not exit the fin 100 entirely but may be directed into airflow spaces between downstream finstrips that are integrally attached thereto. It will further be appreciated from inspection of FIG. 7 that air flowing between the adjacent finstrips 102 will generally undulate according to a wavy path as it moves downstream.

Further, it will be appreciated that the louvers 110, 112, 114, 116, 118, 120, 122 may be provided in alternative embodiments with different relative sizes, different curvatures, and/or in different numbers of louvers on a finstrip 102. Nonetheless, the alternative embodiments of louvers may still provide the above-mentioned mixing of airflows, dividing or bisecting of airflows, and guiding of airflows along a generally wavy path. Further, in alternative embodiments, rather than locating adjacent louvers of the same finstrip 102 so that airflows are bisected, the adjacent louvers may be located so that the leading edges of subsequent downstream located louvers are offset from the trailing edges of the nearest upstream louvers by at least about 25% of the fin pitch distance of a heat exchanger. In other words, in some embodiments, an airflow may be divided into unequal portions as it exits an airflow space. Still further, the overall dimensions of louvers of the various embodiments disclosed may be chosen to minimize the occurrence of trapping water between the louvers and adjacent structures of the fins.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What is claimed is:

1. A fin, comprising:

a substantially flat base plane having a first side facing a first direction and a second side facing a second direction;

a first louver comprising a leading edge and a trailing edge, wherein the first louver leading edge is closer to the base plane than the first louver trailing edge and the first louver trailing edge is offset from the base plane in the first direction;

a second louver located at least partially downstream of the first louver, the second louver comprising a leading edge and a trailing edge, wherein the second louver leading edge is offset from the base plane in the second direction and the second louver trailing edge is offset from the base plane in the first direction; and a third louver located at least partially downstream of the second louver, the third louver comprising a leading edge and a trailing edge, wherein the third louver leading edge is offset from the base plane in the second direction and the third louver trailing edge is closer to the base plane than the third louver leading edge;

wherein the space between the first louver and the second louver is free of louvers and wherein the space between the second louver and the third louver is free of louvers.

2. The fin according to claim 1, further comprising:

a fourth louver located at least partially downstream of the third louver, the fourth louver comprising a leading edge and a trailing edge, wherein both the fourth louver leading edge and the fourth louver trailing edge are offset in the same of one of the first direction and the second direction.

3. The fin according to claim 2, wherein the space between the third louver and the fourth louver is free of louvers.

4. The fin according to claim 2, further comprising:

a fifth louver located at least partially downstream of the fourth louver, the fifth louver comprising a leading edge and a trailing edge, wherein the fifth louver trailing edge is offset from the base plane in the second direction and the fifth louver leading edge is closer to the base plane than the fifth louver trailing edge.

5. The fin according to claim 4, further comprising:

a sixth louver located at least partially downstream of the fifth louver, the sixth louver comprising a leading edge and a trailing edge, wherein the sixth louver leading edge is offset from the base plane in the first direction and the sixth louver trailing edge is offset from the base plane in the second direction.

6. The fin according to claim 5, further comprising:

a seventh louver located at least partially downstream of the sixth louver, the seventh louver comprising a leading edge and a trailing edge, wherein the seventh louver trailing edge is closer to the base plane than the seventh louver leading edge and wherein the seventh louver leading edge is offset from the base plane in the first direction.

7. The fin according to claim 6, wherein no two adjacent louvers are substantially parallel to each other.

8. A heat exchanger slab comprising a plurality of the fin of claim 1.

9. The heat exchanger slab according to claim 8, wherein adjacent base planes of adjacent fins are substantially parallel and offset from each other according to a fin pitch distance.

10. A fin, comprising:

a substantially flat base plane having a first side facing a first direction and a second side facing a second direction;

a flat central louver comprising a leading edge and a trailing edge, wherein the central louver leading edge and the central louver trailing edge are offset from the base plane in the same one of the first direction and the second direction; and a nearest located louver located nearest the central louver, the nearest located louver comprising a nearest located edge located nearest the central louver, wherein the nearest located edge is nearer the base plane than any portion of the central louver and wherein the nearest located louver comprises a concave cross-sectional shape that is open generally vertically away from the central louver.

11. The fin according to claim 10, wherein the central louver is substantially parallel to the base plane.

12. The fin according to claim 10, wherein the central louver leading edge and the central louver trailing edge are located substantially the same distance away from the base plane.

13. The fin according to claim 10, wherein the nearest located edge of the nearest located louver is located at least partially upstream of the central louver.

14. The fin according to claim 10, wherein the nearest located edge of the nearest located louver is located at least partially downstream of the central louver.

15. The fin according to claim 10, further comprising two nearest located louvers, wherein one of the two nearest located louvers is located at least partially upstream of the central louver and wherein the other one of the two nearest located louvers is located at least partially downstream of the central louver.

16. The fin according to claim 10, wherein the central louver is offset from the base plane in the first direction and at least a portion of the nearest located louver is offset from the base plane in the second direction.

17. A fin, comprising:

a substantially flat base plane having a first side facing a first direction and a second side facing a second direction;

a first louver comprising a leading edge and a trailing edge, wherein the first louver leading edge is closer to the base plane than the first louver trailing edge, the first louver trailing edge is offset from the base plane in the first direction, and the first louver is formed into a concave curve open toward the first direction;

a second louver located at least partially downstream of the first louver, the second louver comprising a leading edge and a trailing edge, wherein the second louver leading edge is offset from the base plane in the second direction, the second louver trailing edge is offset from the base plane in the first direction, and the second louver is substantially flat;

a third louver located at least partially downstream of the second louver, the third louver comprising a leading edge and a trailing edge, wherein the third louver leading edge is offset from the base plane in the second direction, the third louver trailing edge is closer to the base plane than the third louver leading edge, and the third louver is formed into a concave curve open toward the second direction;

a fourth louver located at least partially downstream of the third louver, the fourth louver comprising a leading edge and a trailing edge, wherein both the fourth louver leading edge and the fourth louver trailing edge are offset in the first direction, and wherein the fourth louver is substantially flat;

a fifth louver located at least partially downstream of the fourth louver, the fifth louver comprising a leading edge and a trailing edge, wherein the fifth louver trailing edge is offset from the base plane in the second direction, the fifth louver leading edge is closer to the base plane than the fifth louver trailing edge, and the fifth louver is formed into a concave curve open toward the second direction;

a sixth louver located at least partially downstream of the fifth louver, the sixth louver comprising a leading edge and a trailing edge, wherein the sixth louver leading edge is offset from the base plane in the first direction, the sixth louver trailing edge is offset from the base plane in the second direction, and the sixth louver is substantially flat; and a seventh louver located at least partially downstream of the sixth louver, the seventh louver comprising a leading edge and a trailing edge, wherein the seventh louver trailing edge is closer to the base plane than the seventh louver leading edge, the seventh louver leading edge is offset from the base plane in the first direction, and the seventh louver is formed into a concave curve open toward the first direction.

18. The fin according to claim 17, wherein each of the first louver leading edge, the third louver trailing edge, the fifth louver leading edge, and the seventh louver trailing edge are substantially coplanar with the base plane.

19. The fin according to claim 17, wherein the third louver trailing edge and the fifth louver leading edge are substantially coplanar with the base plane and at least one of the first louver leading edge and the seventh louver trailing edge are offset from the base plane in the second direction.

20. The fin according to claim 17, wherein no two adjacent louvers are substantially parallel to each other.

* * * * *